US006540227B2

(12) United States Patent
Inoue

(10) Patent No.: US 6,540,227 B2
(45) Date of Patent: Apr. 1, 2003

(54) SYMBOL DISPLAYING UNIT USED FOR A GAME MACHINE

(75) Inventor: Fumio Inoue, Tokyo (JP)

(73) Assignee: Wing Co., Ltd., Tokyo (JP)

( * ) Notice: Subject to any disclaimer, the term of this patent is extended or adjusted under 35 U.S.C. 154(b) by 111 days.

(21) Appl. No.: 09/866,618

(22) Filed: May 30, 2001

(65) Prior Publication Data

US 2002/0180147 A1 Dec. 5, 2002

(51) Int. Cl.[7] ..... A63B 71/00; A63F 17/34

(52) U.S. Cl. ..... 273/143 R; 273/143 B; 273/143 C; 463/20; 29/203 B; 29/705; 29/740

(58) Field of Search ..... 273/143; 345/205, 345/418; 29/721, 741; 348/739; 312/114, 234; D06/432; 217/11, 58, 10; 463/20

(56) References Cited

U.S. PATENT DOCUMENTS 3,722,061 A * 3/1973 Bowles ..... 345/205
4,363,486 A * 12/1982 Chaudhry et al. ..... 273/143 B
4,411,428 A * 10/1983 Nicolaus ..... 273/143 R
4,458,412 A * 7/1984 Dean et al. ..... 29/705
4,612,700 A * 9/1986 Loomis et al. ..... 29/564.6
5,191,693 A * 3/1993 Umetsu ..... 29/429
5,289,625 A * 3/1994 Umetsu et al. ..... 29/426.3
5,938,196 A * 8/1999 Antoja ..... 273/143 C
6,102,396 A * 8/2000 Liu ..... 273/143 R
6,215,481 B1 * 4/2001 Tanijiri et al. ..... 345/207
6,297,787 B1 * 10/2001 Nishida ..... 345/1.3

FOREIGN PATENT DOCUMENTS

JP 6-39085 2/1994
JP 9-266979 10/1997

* cited by examiner

*Primary Examiner*—Benjamin H. Layno
*Assistant Examiner*—Dolores R. Collins
(74) *Attorney, Agent, or Firm*—Young & Thompson

(57) ABSTRACT

A case of a stepping motor is divided by a partition. One of divided portions of the case contains a rotor and a stator of the stepping motor. A small-sized drive gear is fixed to a drive shaft integrally rotated with the rotor. The drive gear is meshed with a larger gear of a transmission gear. This transmission gear includes a smaller gear integrally rotated with the larger gear. The smaller gear is meshed with a large-sized output gear fixed to an output shaft of the stepping motor. Two pairs of the reduction gear mechanisms transmit a rotation of the drive shaft to the output shaft in a reduced state.

12 Claims, 4 Drawing Sheets

SYMBOL DISPLAYING UNIT USED FOR A GAME MACHINE

BACKGROUND OF THE INVENTION

1. Field of the Invention

The present invention relates to a symbol displaying unit used for a game machine of a slot machine, a Japanese upright pinball machine, and so forth. In particular, the present invention relates to a symbol displaying unit in which a reel having symbols arranged on an outer periphery thereof is driven by a stepping motor.

2. Description of the Related Art

A slot machine using a symbol displaying unit is well known from Japanese Patent Laid-Open Publication No. 6-39085 (Japanese Patent No. 2,920,027) and so forth. In such a symbol displaying unit, nine reels having symbols arranged on outer peripheries thereof are disposed in a three-by-three matrix, and the respective reels are driven by an individual motor. When a start button of the slot machine is operated after putting a certain number of tokens into the slot machine, the symbol displaying unit is activated to simultaneously rotate the nine reels. After that, a stop button is operated to stop the reel. Alternatively, the reels are stopped based on a signal outputted from a random timer. When a specified symbol combination are obtained on any one of judgement lines, it is judged to be a hit. Incidentally, the judgement lines are, for instance, three vertical lines, three horizontal lines and two diagonal lines which are set so as to combine three reels straightly. When the hit occurs, the tokens are paid out in accordance with a number of the invested tokens and a hit combination.

The above symbol displaying unit of the nine-reel type attached to the slot machine is utilized in a recent Japanese upright pinball machine called as "pachinko", such as described in Japanese Patent Laid-Open Publication No. 9-266979. In this pinball machine, the reels are simultaneously rotated when a game ball enters a predetermined start hole. After the reels have stopped, an extra game unit called "attacker" is opened if the hit occurs. While the attacker is opened, almost all of the game balls flowing on a game board enter the attacker. When a predetermined number of the game balls enter the attacker, this attacker is briefly closed, and then is opened again. The operation of the attacker is repeated within an extent of sixteen times, for example. Thus, a player can obtain a large number of game balls when the hit occurs on the symbol displaying unit.

In the slot machine and the pinball machine described above, a pay-out ratio greatly fluctuates in accordance with a frequency of the hit occurring on the symbol displaying unit. In view of this, probability of hit occurrence is controlled by a microcomputer. When the symbol displaying unit is activated, the microcomputer extracts a certain number by using a random-number generator, and controls the motor of the reel so as to satisfy a result corresponding to the extracted number. Extraction of the number is performed under a predetermined probability of the hit occurrence. For the purpose of controlling the motor easily, a stepping motor is utilized as the motor for driving the reel. Based on a number of drive pulses supplied to the stepping motor, stop control of each reel is performed.

Meanwhile, the stepping motor is rotated by unit step angle whenever the drive pulse is supplied thereto. A number of steps necessary for one rotation is fixed. In case the number of steps is small, the step rotation of the reel is found out by a player when a rotational speed of the stepping motor is decreased for stopping the reel. In this case, the player is likely to have a strange feeling. This problem may be improved by using the stepping motor whose unit step angle is small, or whose step number for one rotation is large. However, such a stepping motor has a large size and is expensive so that it is difficult, because of a space for attachment and so forth, to use this stepping motor for the symbol displaying unit having nine reels arranged in the three-by-three matrix. Especially, it is difficult to be employed in the symbol displaying unit used for the pinball machine.

In the meantime, such as described in the foregoing Publication No. 9-266979, is well known a structure in which a gear fixed to a drive shaft of the stepping motor is meshed with an internal gear formed on an inner periphery of a rotary bearing. The gear of the drive shaft has a small number of teeth, and the internal gear of the rotary bearing has a large number of teeth. In this structure, the rotation of the stepping motor is transmitted to the reel in a reduction state. For the purpose of making the low-speed step rotation inconspicuous under usage of one-pair gears, it is required to increase the teeth number of the internal gear. Thus, it is necessary to enlarge the reel. Moreover, since the gear fixed to the drive shaft of the stepping motor is meshed with the internal gear of the reel in a state that the reel is rotatably supported by a fixed supporting shaft, there arise problems in that a number of parts for constituting a reel assembly increases, and in that assembling these parts becomes complicated. Further, since driving force is transmitted at a position separated from the rotational center of the reel, there arises another problem in that the rotation of the reel is likely to be biased in accordance with repetition of usage.

SUMMARY OF THE INVENTION

In view of the foregoing, it is a primary object of the present invention to provide a symbol displaying unit used for a game machine in which a reel can be downsized.

It is a second object of the present invention to provide a symbol displaying unit used for a game machine in which a reel may be smoothly rotated, using a stepping motor whose step number is small.

In order to achieve the above and other objects, the symbol displaying unit according to the present invention comprises a stepping motor, in a motor case of which at least two pairs of reduction gear mechanisms are contained.

The stepping motor includes a drive shaft and an output shaft. The drive shaft is integrally rotated with a rotor of the stepping motor, and the output shaft projects to the outside of the motor case. A rotation of the drive shaft is transmitted to the output shaft in a reduced state by the reduction gear mechanisms. Further, the motor case is disposed inside a reel so as to secure the output shaft to the reel.

The top of the output shaft is provided with a reel attaching portion having a contour of a non-circular shape. Meanwhile, one side of the reel is integrally formed with an attachment portion, an inner shape of which corresponds to the contour of the reel attaching portion of the output shaft. When fixing the reel to the output shaft, the reel attaching portion of the output shaft is fitted into the attachment portion of the reel. Then, a central portion of the reel is fastened to the top of the output shaft with a screw.

According to the present invention, the rotation of the drive shaft is transmitted to the output shaft in a considerably reduced state by at least two pairs of the reduction gear mechanisms contained in the motor case. Thus, it is not necessary to extremely increase the step number of the stepping motor itself. In virtue of this, the reel can be smoothly rotated although the reel is directly connected to the output shaft of the stepping motor. Since it is not necessary to increase the step number of the stepping motor, the rotor and the stator of the stepping motor may be downsized. Owing to this, the motor case as a whole is disposed inside the reel without increasing a diameter of the reel so that the whole of the symbol displaying unit may be effectively downsized.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT (S)

Figure 1:
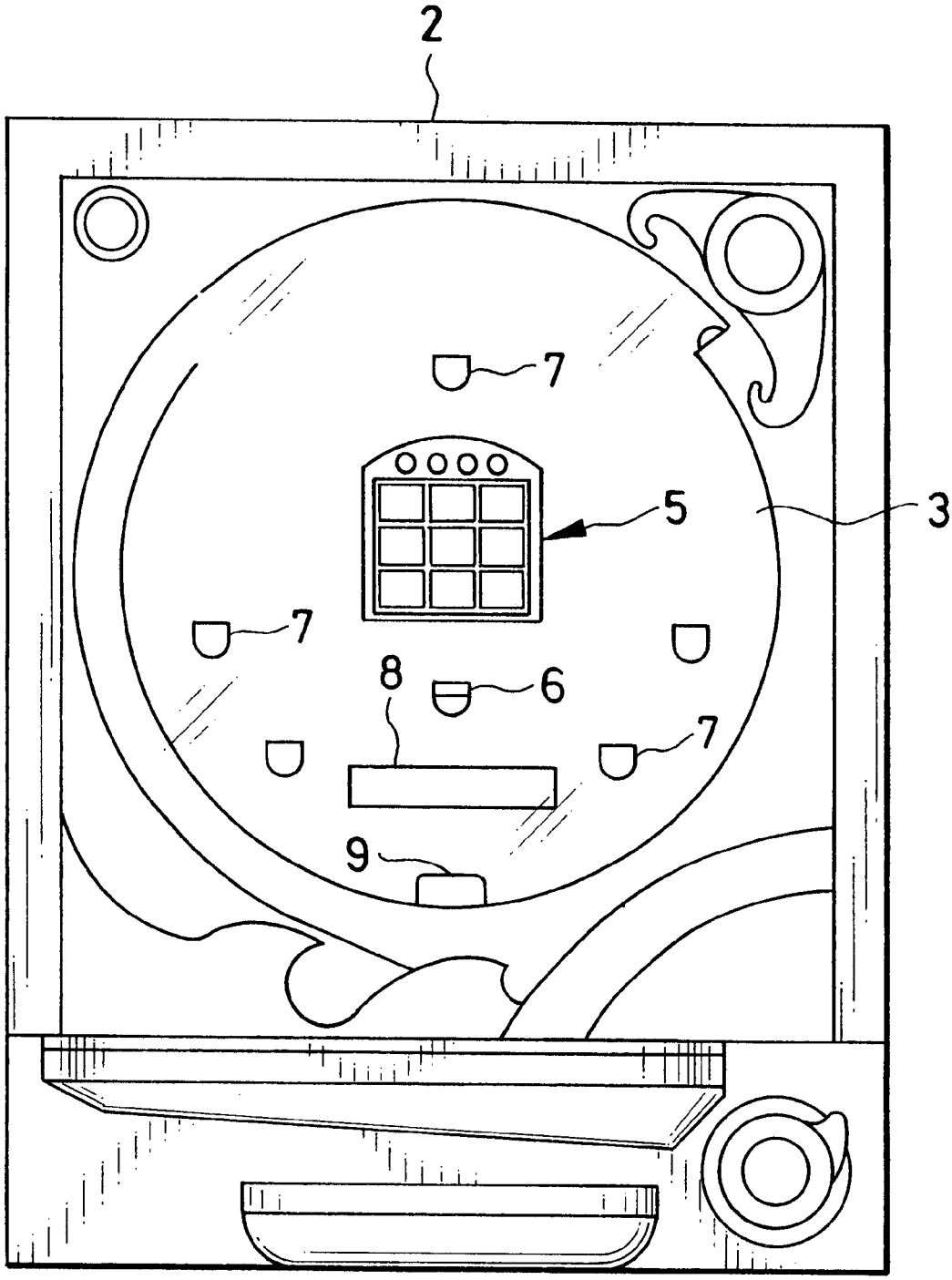
FIG. 1 is a front view showing a Japanese upright pinball machine using a symbol displaying unit according to the present invention.

FIG. 1 shows a Japanese upright pinball machine 2 to which a symbol displaying unit 5 is attached. The symbol displaying unit 5 is disposed at a game surface 3 of the pinball machine 2. A start hole 6 is provided at a central portion of the game surface 3. Besides the start hole 6, the game surface 3 is provided with normal winning holes 7, an openable plate 8 called as "attacker", and an out hole 9. Further, on the game surface 3, are provided pins, rotary elements and so forth, although these are not shown. The symbol displaying unit 5 is for attracting interest of the pinball game, such as described below.

A game ball is shot up one by one toward the game surface 3 by a ball shooting unit. The shot game ball enters any of the start hole 6, the normal winning hole 7 and the out hole 9. When the openable plate 8 is opened, the game ball comes therein as well. In response to the game ball having entered the start hole 6, the symbol displaying unit 5 is activated to simultaneously rotate reels thereof disposed behind a display window. The reels are arranged in a three-by-three matrix, and each of them is stopped after a proper period to display symbol combinations along judgment lines. These judgment lines are three vertical lines, three horizontal lines, and two diagonal lines. If a specific combination, for instance "7-7-7", is displayed on any of the judgement lines, winning is obtained. When the winning occurs, the openable plate 8 is opened so that the game ball easily comes therein. While the symbol displaying unit 5 is activated, the game ball may enter the start hole 6. This game ball is memorized as a reserved ball up to four, for example. When the reserved ball is memorized, the symbol displaying unit 5 is successively activated after one sequence of operations has been completed.

When the game ball enters any of the start hole 6, the normal winning holes 7 and the openable plate 8, a certain number of the game balls are paid out. Once the openable plate 8 is opened, this plate 8 is continued to be opened until a predetermined number of the game balls (for instance ten balls) come therein. The openable plate 8 is momentarily closed after the predetermined number of the game balls have come therein. After that, however, the openable plate 8 is successively opened again. This operation of the openable plate 8 is repeated within an extent of sixteen times. Accordingly, a large number of the game balls are obtained when the winning occurs on the symbol displaying unit 5.

The symbol displaying unit 5 is attached to the game surface 3 of the pinball machine 2 so that the symbol displaying unit 5 should be extremely downsized in comparison with that used in a slot machine. For this reason, an outer diameter of the reel rotating behind the display window has a limitation of about 50 mm, for instance. Moreover, the respective reels should not be separately disposed from each other. Further, each of the reels needs an individual stepping motor for driving. In order to downsize the symbol displaying unit 5, the stepping motor is required to be disposed inside the reel such as described later.

Figure 2:
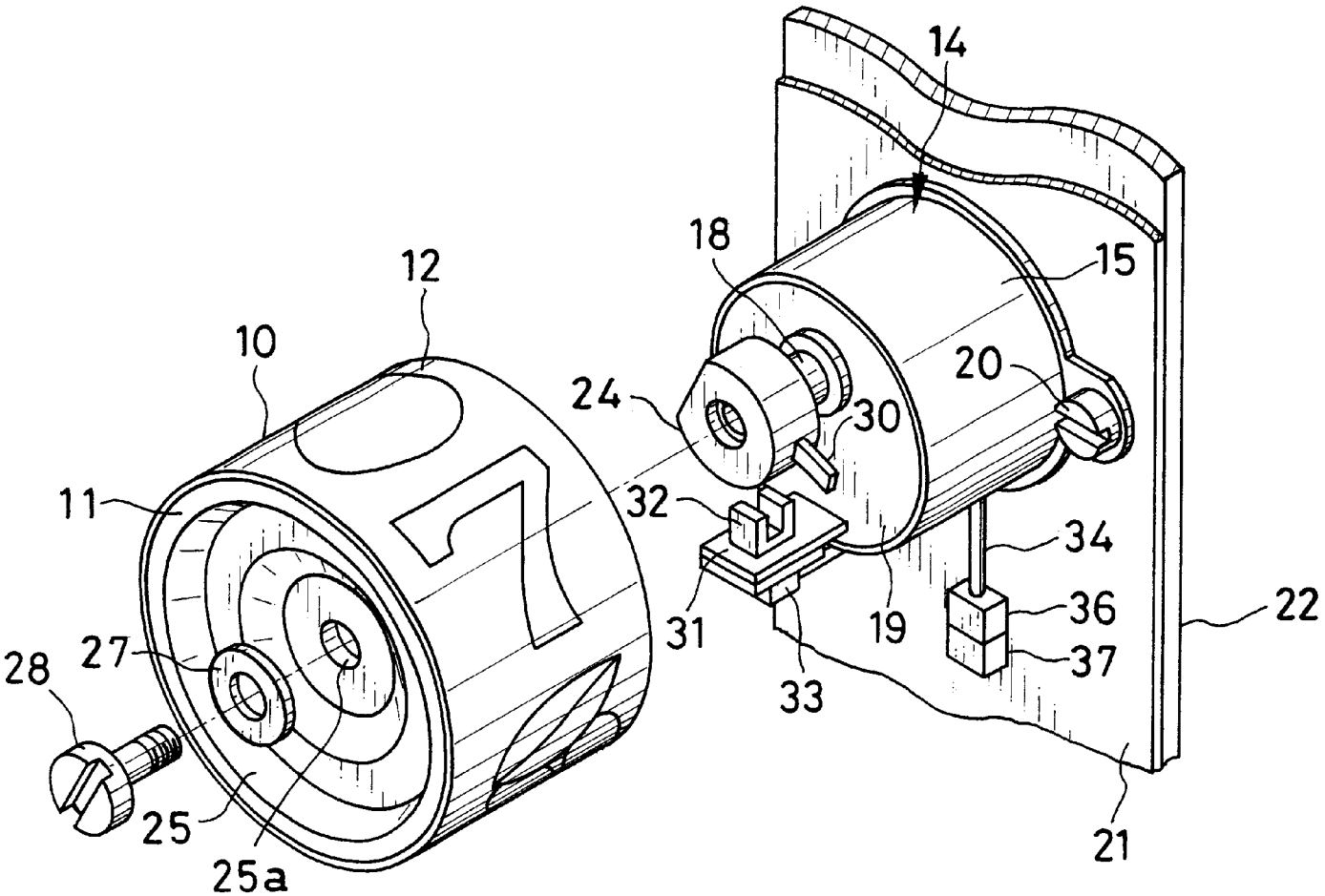
FIG. 2 is an exploded perspective view of the symbol displaying unit.

As shown in FIG. 2, symbols of "fruit", "7" and so forth are arranged on a periphery of the reel 10 at predetermined intervals. The reel 10 is formed such that a symbol sheet 12 on which the symbols are printed is mounted on a reel body 11 which is made of a plastic as a single piece. Incidentally, the symbol displaying unit 5 includes nine reels and nine stepping motors having identical structures so that one pair of them is merely described below.

Figure 3:
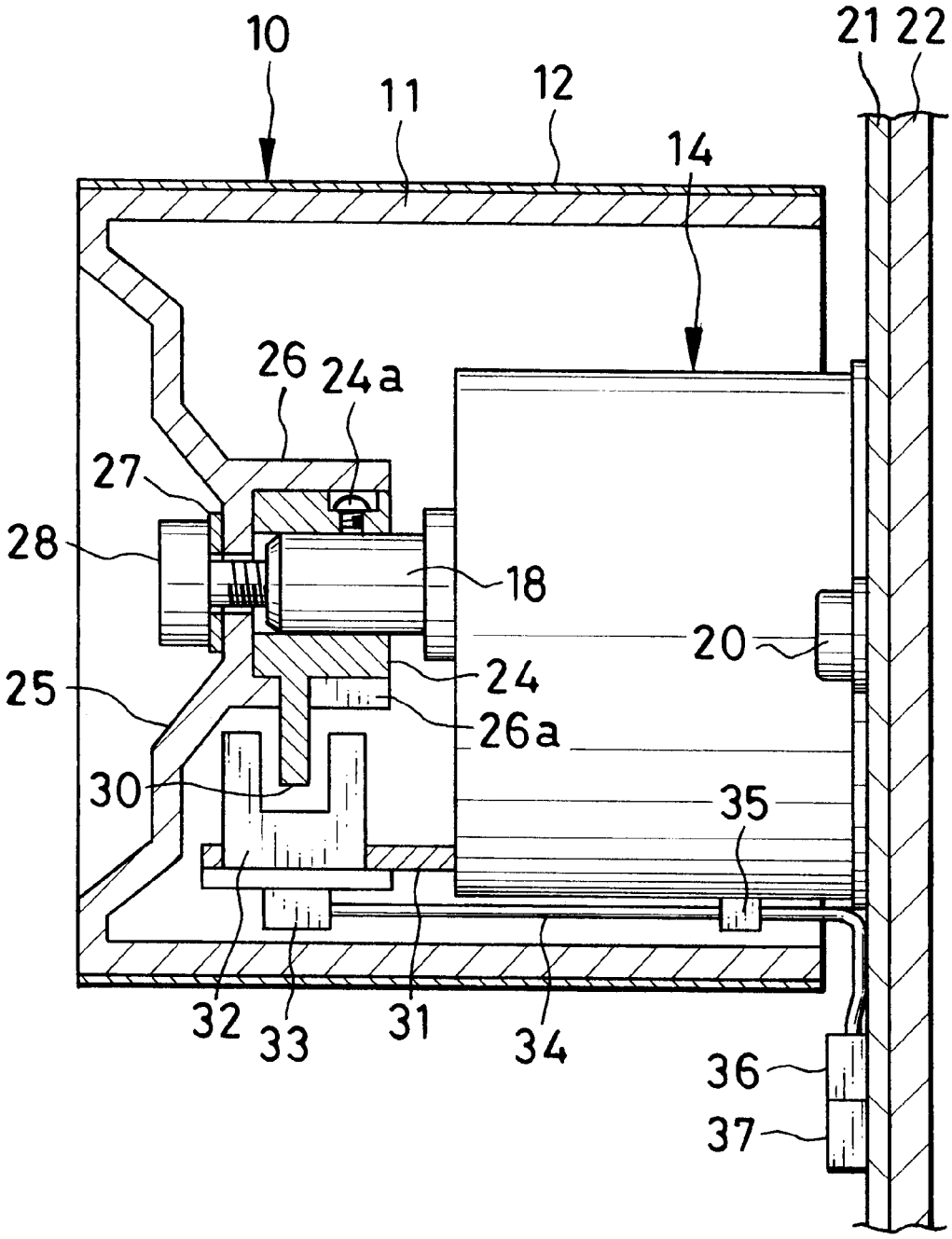
FIG. 3 is a partially sectional view showing the symbol displaying unit.
Figure 4:
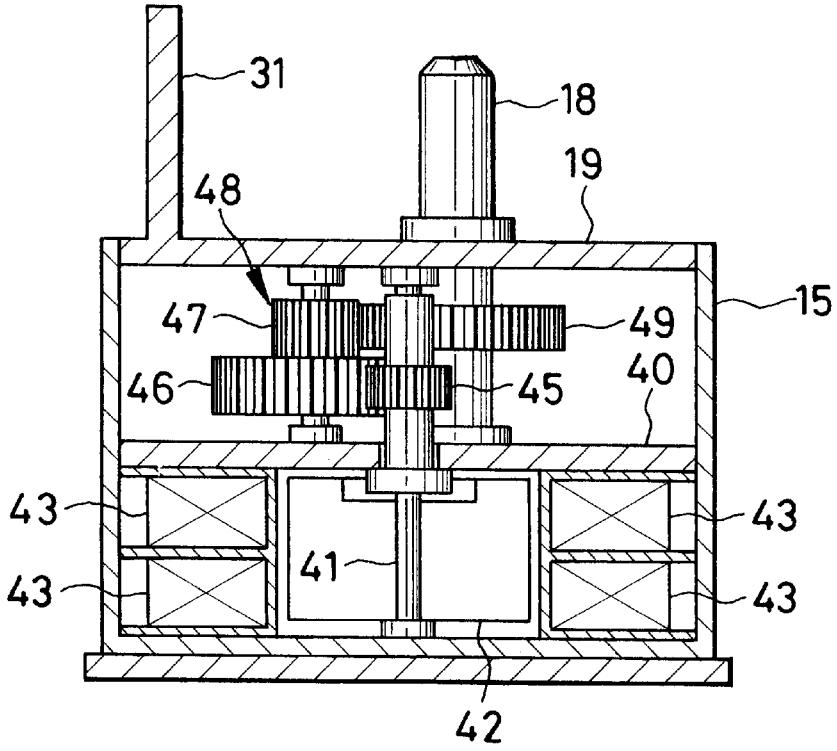
FIG. 4 is a partially sectional view showing a stepping motor.

As shown in FIGS. 3 and 4, the stepping motor 14 includes a case 15, a rotor 42 and a stator 43. An output shaft 18 projects from a cover plate 19 covering one side of the case 15. The stepping motor 14 is fixed to a support plate 22 by a screw 20 together with a motor board 21. The support plate 22 is vertically provided. Thus, the output shaft 18 becomes horizontal and the reel 10 rotates around the horizontal output shaft 18. A hub 24 for fixing the reel 10 is secured to the top of the output shaft 18. Such as shown in FIG. 3, a screw **24*a* is used for securing the hub 24 to the output shaft 18. However, the hub 24 may be tightly fitted with the output shaft 18**.

The reel body 11 has a cylindrical shape, a right side of which in the drawing is opened and a left side of which is integrally formed with a holding wall 25 having a recess of a step-like shape. A central portion of the holding wall 25 is formed with an opening **25*a*. Moreover, the central portion of the holding wall 25 is integrally formed with an attachment portion 26 protruding in a cup-like shape toward the other side of the reel body 11. When the reel 10 is attached to the output shaft 18 in an axis direction, the attachment portion 26 is joined to the hub 24 so as to cover it. By the way, the holding wall 25 may be provided with an opening in order to lighten the reel 10**.

A periphery of the hub 24 is formed in a D-like shape so that a contour thereof is not circular. In accordance with the shape of the hub 24, an inner shape of the attachment portion 26 is not circular as well. Owing to this, the reel 10 is fixed to the output shaft 18 so as not to be shifted in a rotational direction. It is needless to say that the hub 24 may be formed in an oval shape instead of the D-like shape. A screw 28 is inserted into the opening **25*a* of the holding wall 25 via washer 27. Further, the screw 28 passes through a central hole of the hub 24 to be meshed with a female screw formed at the top of the output shaft 18. In virtue of this, the reel 10 is fixed to the output shaft 18 relative to the axis direction. At the same time, almost all of the stepping motor 14 is disposed inside the reel 10 together with the case 15**.

If the top of the output shaft itself is formed in a D-like shape for attaching the reel thereto, it is possible to remove the hub 24 which is individually provided for the output shaft 18. Meanwhile, in the case of using the hub 24, an end side thereof may be formed with a female screw to be meshed with the screw 28 for fixing the reel 10.

The periphery of the hub 24 is integrally formed with a projection 30 protruding in a radius direction of the hub 24. The projection 30 is used for detecting one rotation of the output shaft 18. To the cover plate 19, is fixed a sensor supporting plate 31 extending parallel with the output shaft 18. The sensor supporting plate 31 retains a photo sensor 32 comprising a light emitting element and a light receiving element. While the hub 24 is rotated in accordance with the rotation of the output shaft 18, the projection 30 is detected at timing of passing through a space between the light emitting element and the light receiving element. Since the reel 10 is integrally rotated with the hub 24, a timing signal obtained from the photo sensor 32 can be used as a signal representing that the reel 10 has passed a reference position every rotation. Incidentally, the attachment portion 26 of the reel 10 is formed with a slit 26*a*. In virtue of this, when the attachment portion 26 is fitted to the hub 24, the projection 30 does not disturb it. As to the photo sensor 32, it is possible to employ a reflection-type sensor.

The reel 10 is driven by the stepping motor 14 which is rotated in accordance with a number of drive pulses supplied thereto. The number of the drive pulses required for one rotation of the reel 10 is known in advance so that it is possible to recognize a rotational position of the reel 10 on the basis of a count value obtained from a counter counting the supplied number of the drive pulses. This counter is reset whenever the timing signal is detected. Kinds and order of the symbols arranged on the periphery of the reel 10 are also known in advance so that it is possible to recognize the kind of the displayed symbol on the basis of the counted value of the counter. Hence, it is possible to control winning occurrence on the symbol displaying unit by a microcomputer.

As described above, the hub 24 fixed to the output shaft 18 and rotated together with the reel 10 is integrally formed with the projection 30. Owing to this, it is possible to adjust the reference position of the reel 10 relative to the rotational position of the stepping motor 14 by adjusting the position of the hub 24 in the rotational direction, in a state that the reel 10 is not attached to the output shaft 18. Thus, the positional adjustment can be easily performed.

A back side of the photo sensor 32 is connected to a signal line 34 via a connector 33. Wiring of the signal line 34 is performed along a wall of the case 15 with a clasp 35 disposed on this wall, so as not to disturb the rotation of the reel 10. The signal line 34 is connected to connectors 36 and 37 fixed to the motor board 21. Further, the signal line 34 is connected to a circuit unit provided on the motor board 21.

As shown in FIG. 4, the inside of the case 15 is divided into a motor chamber and a gear chamber by a partition 40 through which a drive shaft 41 passes. Both ends of the drive shaft 41 are respectively supported by bearings so as to be rotatable. The rotor 42 is fixed to the drive shaft 41, and the stator 43 is fixed to the inside of the case 15 so as to surround the rotor 42. Structures of the rotor 42 and the stator 43 are well known from the foregoing Publication No. 9-266979 etc. so that detailed explanation thereof is omitted. In brief, the drive shaft 41 is rotated stepwise upon supplying the drive pulse to the stator 43. In this embodiment, a step number of the drive shaft 41 is adapted to be "48". In other words, the drive shaft 41 is adapted to be rotated by an angle of 7.5 degrees per drive pulse.

Figure 5:
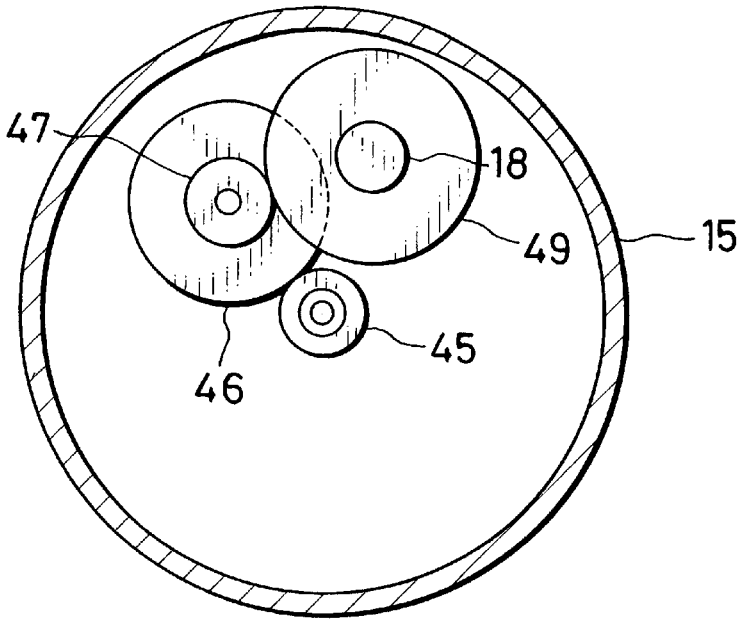
FIG. 5 is a schematic illustration showing a structure of reduction gear mechanisms.

A drive gear 45 is fixed to the drive shaft 41 extended into the gear chamber. In the gear chamber, a transmission gear 48 is rotatably supported by bearings respectively provided on the cover plate 19 and the partition 40. The transmission gear 48 is formed such that a larger gear 46 and a smaller gear 47 are unified so as to be coaxially rotated. Further, the output shaft 18 to which an output gear 49 is fixed is rotatably supported. As shown in FIG. 5, the small-sized drive gear 45 is meshed with the larger gear 46, and the large-sized output gear 49 is meshed with the smaller gear 47. In virtue of this gear structure, the rotation of the drive shaft 41 is transmitted to the output shaft 18 via two pairs of reduction gear mechanisms.

A teeth number of the drive gear 45 is ten. A teeth number of the larger gear 46 is twenty five. A teeth number of the smaller gear 47 is ten. A teeth number of the output gear 49 is thirty. Accordingly, a total reduction ratio of these gears is expressed as follows:

$$(10/25)\times(10/30)=(1/7.5)$$

This means that the output shaft 18 is rotated by a 1° angle upon rotating the drive shaft 41 by a 7.5° angle. Thus, even though the unit step angle of the drive shaft 41 is set to the 7.5° angle by the rotor 42 and the stator 43, the reel 10 is smoothly rotated because a unit step angle of the output shaft 18 is reduced to the 1° angle. The step rotation of the reel 10 is adapted to be almost inconspicuous when the reel 10 is rotated at a low speed. In addition, the reel 10 is directly connected to the output shaft 18 so that a rotational axis of the reel 10 is prevented from being biased even if the reel 10 is continuously used.

When fixing the reel 10 to the output shaft 18, it is possible to secure the reel 10 in the rotational direction and in the axis direction only by fastening the attachment portion 26 to the hub 24 with the screw 28. Moreover, fixing the reel 10 is efficiently performed. When the kinds and the arrangement of the symbols are changed for the purpose of remodelling, it is simply required to attach another reel 10 after taking off the screw 28. This operation is very easy.

In the above embodiment, the reduction ratio of "1/7.5" is obtained from the two pairs of the reduction gear mechanisms. The teeth numbers of the gears may be properly changed, and the reduction gear mechanisms of three pairs or more may be provided in the gear chamber. Moreover, the present invention is not exclusive to the symbol displaying unit attached to the pinball machine. The present invention is applicable to a slot machine and the other game machines having similar structure.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A symbol displaying unit used for a game machine, said symbol displaying unit rotating a reel on which a plurality of symbols are arranged, and any of said symbols being displayed when said reel is stopped, said symbol displaying unit comprising:

a stepping motor for rotating said reel;

a motor case of said stepping motor, said motor case being disposed inside said reel;

an output shaft of said stepping motor projecting toward the outside of said motor case, said output shaft being fixed to said reel;

first and second reduction gear mechanisms contained in said motor case, said first and second reduction gear mechanisms transmitting rotation of a drive shaft of said stepping motor to said output shaft of said stepping motor in a reduced state.

2. A symbol displaying unit according to claim 1, wherein an end of said output shaft has a reel attaching portion whose contour is a non-circular shape, and one side of said reel has an attachment portion whose inner shape corresponds to the contour of said reel attaching portion, said attachment portion being fitted with said reel attaching portion to fix said reel in a rotational direction.

3. A symbol displaying unit according to claim 2, wherein said attachment portion of said reel is fastened to the end of said output shaft with a screw to fix said reel in an axis direction.

4. A symbol displaying unit according to claim 3, wherein said first reduction gear mechanism comprises a drive gear fixed to said drive shaft of said stepping motor and a first gear meshing with said drive gear, and said second reduction gear mechanism comprises an output gear fixed to said output shaft of said stepping motor and a second gear meshing with said output gear, wherein said first gear is larger than said drive gear and said second gear is smaller than said output gear.

5. A symbol displaying unit according to claim 4, wherein a teeth number of said first gear is greater than a teeth number of said second gear.

6. A symbol displaying unit according to claim 5, wherein said first gear and said second gear are coaxially rotated.

7. A symbol displaying unit according to claim 6, wherein said first gear and said second gear are unified.

8. A symbol displaying unit according to claim 7, further comprising:

a partition for dividing the inside of said motor case, said reduction gear mechanisms being contained in a gear chamber formed by said partition.

9. A symbol displaying unit according to claim 2, further comprising:

a projection integrally rotated with said output shaft of said stepping motor;

a sensor for detecting said projection, said sensor detecting one rotation of said output shaft; and a sensor supporting member to which said sensor is fixed, said sensor supporting member extending in parallel with said output shaft.

10. A symbol displaying unit according to claim 9, wherein said sensor supporting member is provided on a side face of said motor case from which said output shaft protrudes.

11. A symbol displaying unit according to claim 10, wherein said projection is integrally formed with said reel attaching portion of said output shaft.

12. A symbol displaying unit according to claim 11, wherein said sensor is a photo sensor.

* * * * *